US008365927B2

(12) United States Patent
Koziak

(10) Patent No.: US 8,365,927 B2
(45) Date of Patent: Feb. 5, 2013

(54) CURTAIN HOLDER

(76) Inventor: Zenon Koziak, Edmonton (CA)

( * ) Notice: Subject to any disclaimer, the term of this patent is extended or adjusted under 35 U.S.C. 154(b) by 100 days.

(21) Appl. No.: 12/958,822

(22) Filed: Dec. 2, 2010

(65) Prior Publication Data

US 2011/0073727 A1 Mar. 31, 2011

Related U.S. Application Data

(63) Continuation-in-part of application No. 11/142,199, filed on Jun. 1, 2005, now abandoned.

(30) Foreign Application Priority Data

Jun. 10, 2004 (CA) ..... 2472632

(51) Int. Cl.
*A47F 5/08* (2006.01)

(52) U.S. Cl. ..... 211/106.01

(58) Field of Classification Search ..... 211/105.2, 211/105.1, 105.5, 123, 105.12, 106.01, 86.01, 211/87.01, 183; 160/349.1, 349.2, 348, 402; 248/208, 294.1, 261, 262; 24/598.3, 599.1, 24/599.3, 599.4

See application file for complete search history.

(56) References Cited

U.S. PATENT DOCUMENTS

| | | | | |
|---|---|---|---|---|
| 827,000 | A | 7/1906 | Dinsmore | |
| 1,291,015 | A * | 1/1919 | Keller | 24/517 |
| 1,349,933 | A * | 8/1920 | Zeitz | 248/255 |
| 1,562,456 | A * | 11/1925 | Klang | 248/289.11 |
| 1,741,505 | A * | 12/1929 | Dalton | 248/308 |
| 1,757,301 | A * | 5/1930 | Ferguson | 24/344 |
| 1,817,962 | A * | 8/1931 | Breuer | 248/308 |
| 1,836,018 | A * | 12/1931 | Dover | 248/208 |
| 2,119,815 | A * | 6/1938 | Huber | 248/208 |
| 2,154,161 | A * | 4/1939 | Heckman | 248/308 |
| 2,316,337 | A * | 4/1943 | Kenney | 160/330 |
| 2,329,446 | A * | 9/1943 | Whitehead et al. | 160/349.2 |
| 2,337,950 | A * | 12/1943 | Werner et al. | 160/330 |
| 2,431,934 | A * | 12/1947 | Higgins | 160/349.2 |
| 2,470,233 | A * | 5/1949 | Boye | 160/349.2 |
| 2,637,384 | A * | 5/1953 | McCabe | 160/349.2 |
| 2,666,481 | A * | 1/1954 | White | 160/348 |
| 4,022,415 | A * | 5/1977 | Roderick et al. | 248/298.1 |
| 5,078,199 | A * | 1/1992 | Hannerstig | 160/348 |
| 5,367,742 | A * | 11/1994 | Bindman | 16/87.2 |
| D367,578 | S * | 3/1996 | Locke | D6/579 |
| 5,669,085 | A * | 9/1997 | Wilson | 4/605 |
| 5,775,401 | A * | 7/1998 | Faurie | 160/349.2 |
| 6,015,004 | A * | 1/2000 | Harkinson | 160/349.1 |
| 6,484,235 | B1 * | 11/2002 | Horst et al. | 711/114 |
| 2005/0286886 | A1 * | 12/2005 | Koziak | 396/318 |

* cited by examiner

*Primary Examiner* — Jennifer E. Novosad
(74) *Attorney, Agent, or Firm* — Davis & Bujold, P.L.L.C.

(57) ABSTRACT

A curtain holder includes a mounting plate having a flat surface for mounting flush against a vertical surface. A substantially annular body is pivotally mounted to the mounting plate for pivotal movement about a horizontal pivot axis extending parallel to the mounting plate, such that the body moves up and down about the horizontal pivot axis. The body has at least two body segments pivotally connected for pivotal movement about a substantially vertical pivot axis which is offset from and independent of the mounting plate. The body segments pivot relative to each other about the vertical pivot axis between a closed position in which the body defines a curtain confining enclosure and an open position in which at least one of the body segments pivots away from the mounting plate to permit insertion of a curtain into the curtain confining enclosure.

8 Claims, 11 Drawing Sheets

CURTAIN HOLDER

FIELD OF THE INVENTION

The present invention relates to a curtain holder.

BACKGROUND OF THE INVENTION

Curtain holders are used to hold shower curtains together.

SUMMARY OF THE INVENTION

The present invention relates to a novel configuration of curtain holder.

According to the present invention there is provided a curtain holder with a mounting plate having a flat surface for mounting flush against a vertical surface. A substantially annular body is pivotally mounted to the mounting plate for pivotal movement about a horizontal pivot axis extending parallel to the mounting plate, such that the body moves up and down about the horizontal pivot axis. The body has at least two body segments pivotally connected for pivotal movement about a substantially vertical pivot axis which is offset from and independent of the mounting plate. The body segments pivot relative to each other about the vertical pivot axis between a closed position in which the body defines a curtain confining enclosure and an open position in which at least one of the body segments pivots about the vertical pivot axis away from the mounting plate to permit insertion of a curtain into the curtain confining enclosure.

There will hereinafter be described various embodiments of curtain holder. The preferred embodiments are illustrated in FIGS. 20, 21, 23 and 24.

FIGS. 20 and 21, disclose early versions having a horizontal pivot axis. In preparing a commercial embodiment illustrated in FIGS. 23 and 24, it has been determined that the preferred configuration to define the horizontal pivot axis is for the mounting plate to supports a female receiver in a horizontal orientation. The female receiver consists of more than one receiver segments with a bore defining the horizontal pivot axis. One of the two body segments of the body is a male member which is received in the female receiver in mating relation. The male member rotates in the female receiver to create pivotal movement of the body about the horizontal first pivot axis.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
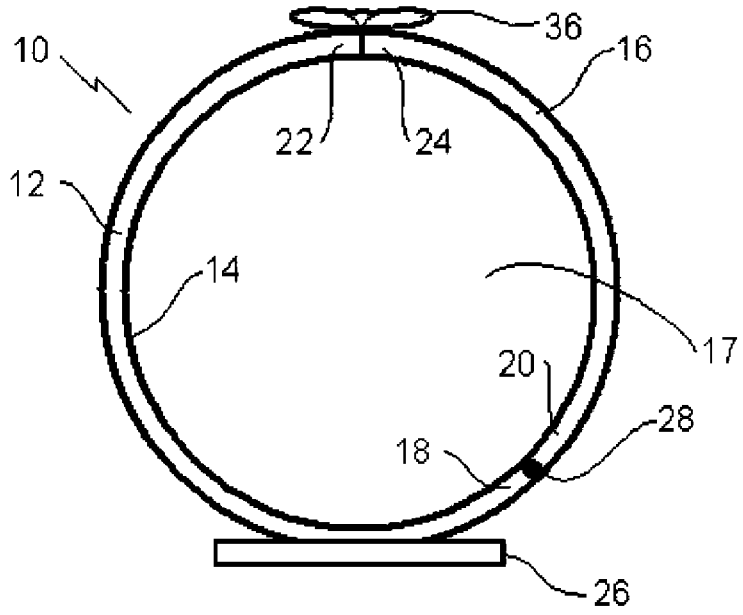
FIG. 1 is a top plan view of the curtain holder in the closed position.

The preferred embodiment, a curtain holder generally identified by reference numeral 10, will now be described with reference to FIGS. 1 through 4 and 18.

Figure 2:
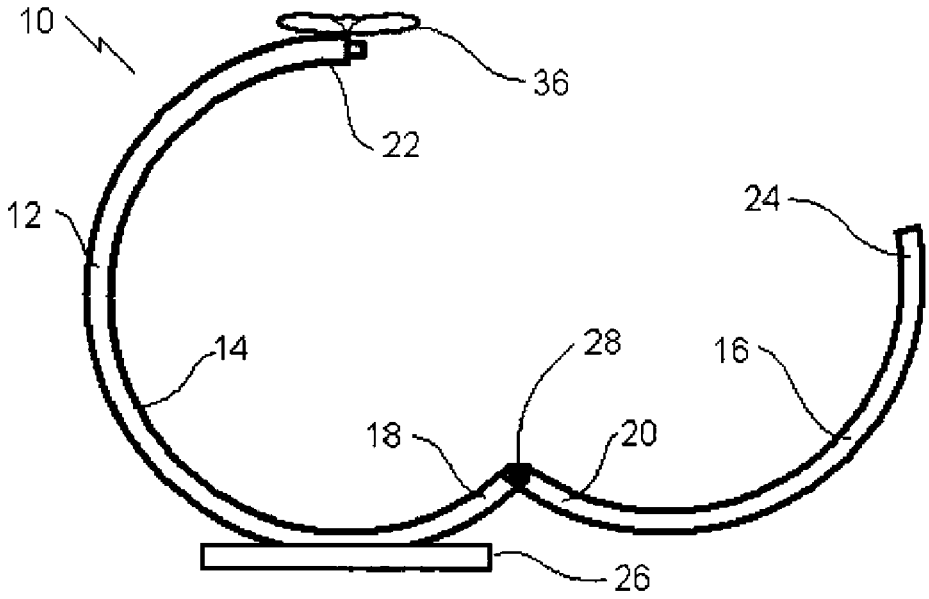
FIG. 2 is a top plan view of the curtain holder in the open position.
Figure 3:
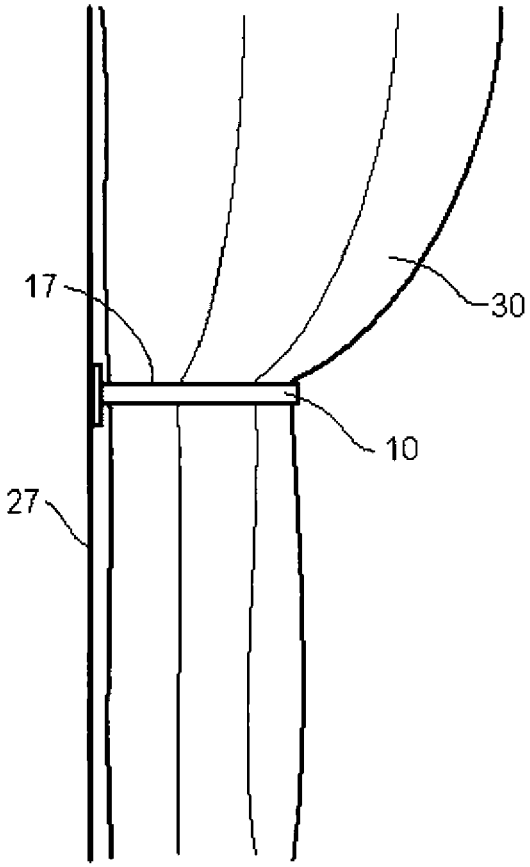
FIG. 3 is a side view of the curtain holder being used to hold back a curtain.
Figure 18:
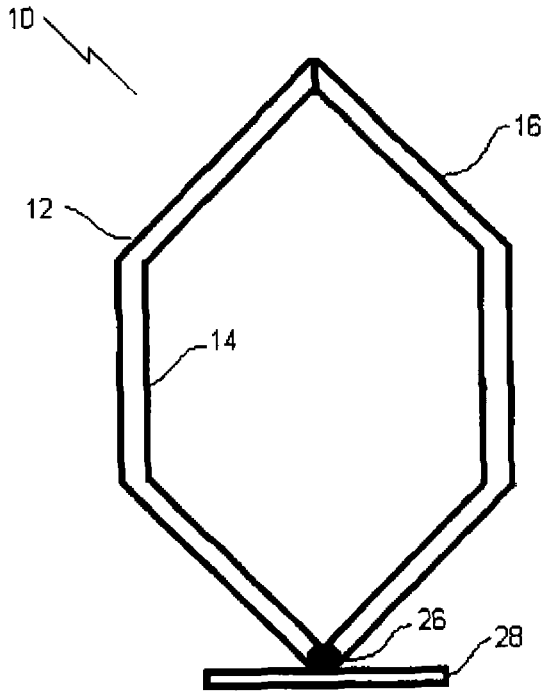

Structure and Relationship of Parts:

Referring now to FIG. 1, curtain holder 10 is shown. A generally annular body 12 is formed from two or more connected segments, 14 and 16 that define a curtain confining enclosure 17. Each segment 14 and 16 has a connection end 18 and 20 respectively, and a remote end 22 and 24 respectively. A mounting plate 26 provides means for mounting annular body 12 to a vertical surface 27, as shown in FIG. 3. Referring again to FIG. 1, a hinge 28 is offset from, and independent of, mounting plate 26. Referring to FIG. 18, hinge 28 may also be located in the center of mounting plate 26. Referring again to FIG. 1 hinge 28 pivotally connects connection ends 18 and 20 of segments 14 and 16, such that segments 14 and 16 are pivotally movable between an open position shown in FIG. 2 and a closed position shown in FIG. 1. Referring now to FIG. 2, in the open position, remote ends 22 and 24 are spaced apart to permit insertion of a curtain 30 into curtain confining enclosure 17, as shown in FIG. 3. Referring now to FIG. 1, in the closed position, remote ends 22 and 24 are closely spaced. As can be seen from the top view provided in FIGS. 1 and 2, hinge 28 pivots about a substantially vertical pivot axis. Because hinge 28 is offset from mounting plate 26, segments 14 and 16 are unequal in size to allow remote ends 22 and 24 to meet opposite mounting plate 26.

Figure 4:
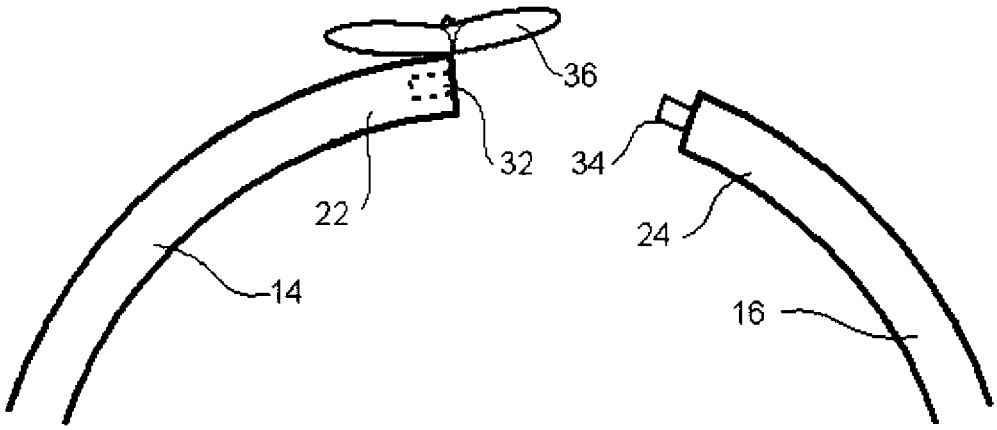
FIG. 4 is a detailed top view in partial section of interlocking components.

Referring to FIG. 4, remote ends 22 and 24 have first and second engagements 32 and 34 respectively, such that first engagement 32 and second engagement 34 matingly engage when segments 14 and 16 are in the closed position. Remote end 24 has a decorative member 36 which conceals first engagement 32 and second engagement 34 when segments 14 and 16 are in the closed position.

Operation:

The operation of curtain holder 10 will now be discussed with reference to FIGS. 1 through 4. Curtain holder 10 is mounted on a vertical surface 27 as shown in FIG. 3. Body 12 is originally in the closed position as shown in FIG. 1, with remote ends 22 and 24 engaged. Referring now to FIG. 2, segment 16 is pivoted about hinge 28 into the opened position. Referring now to FIG. 3, curtain 30 is placed within the opening created by pivoting segment 16 about hinge 28, and segment 16 is then returned to its original position such that remote ends 22 and 24 are engaged. Curtain 30 is removed by repeating the process.

Variations:

Variations from the preferred embodiment will now be discussed with reference to FIGS. 5 through 18.

Pivoting about a Horizontal Pivot Axis:

Referring to FIG. 4, hinge 28 may pivot about a substantially horizontal pivot axis. As shown, segment 16 is adapted to be lifted up, and first engagement 32 is adapted to receive second engagement 34 with an opening in the top such that segment 16 may be easily lifted.

Figure 6:
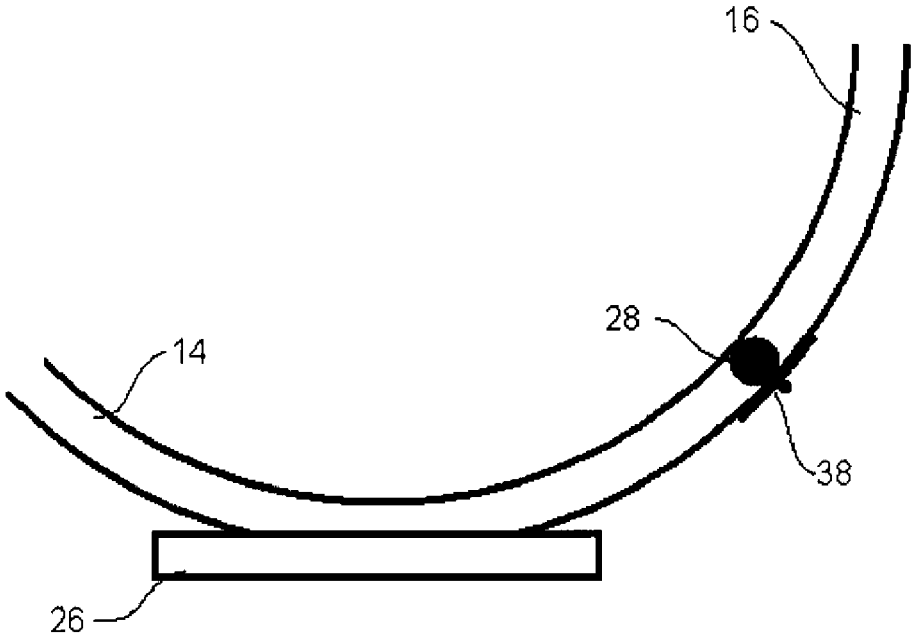
FIG. 6 in a detailed top plan view of alternative mounting means and another alternative hinge.

Biasing to a Closed Position:

Referring to FIG. 6, segments 14 and 16 are biased toward the closed position by a spring 38, which may be replaced by a different resilient material. Spring 38 may be located on the outside of annular body 12, as shown, or on the inside. Alternatively, spring 38 may be included within hinge 28.

Figure 7:
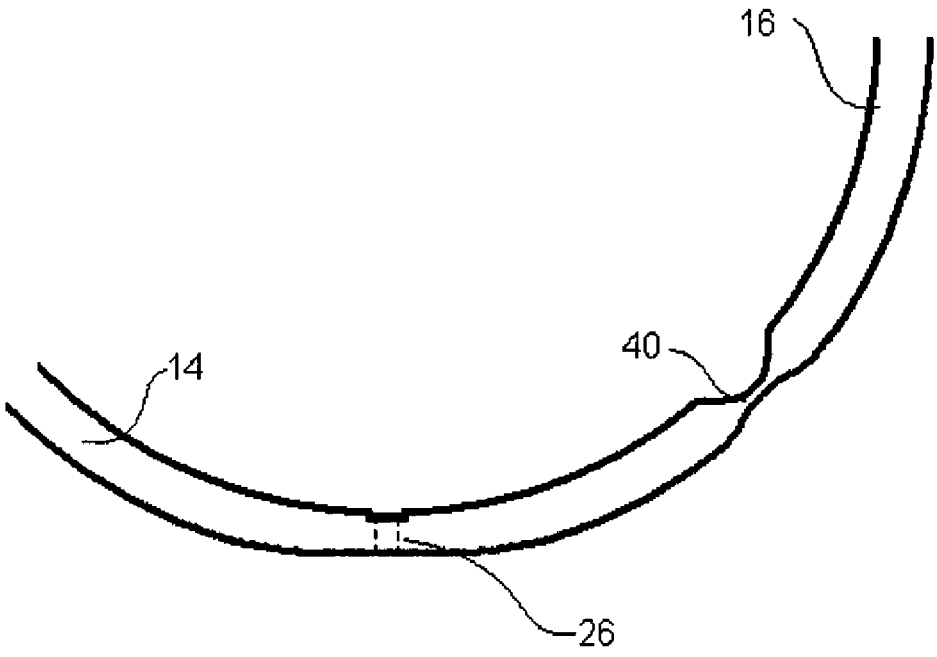
FIG. 7 is a detailed top plan view of another alternative hinge.

Use of a "Living Hinge":

Referring now to FIG. 7, annular body 12 is made from polymer plastic and hinge 40 is a living hinge formed in the polymer plastic which functions based upon the flexure properties of the polymer plastic. A living hinge is a thin flexible web of material that joins two rigid bodies together.

Figure 8:
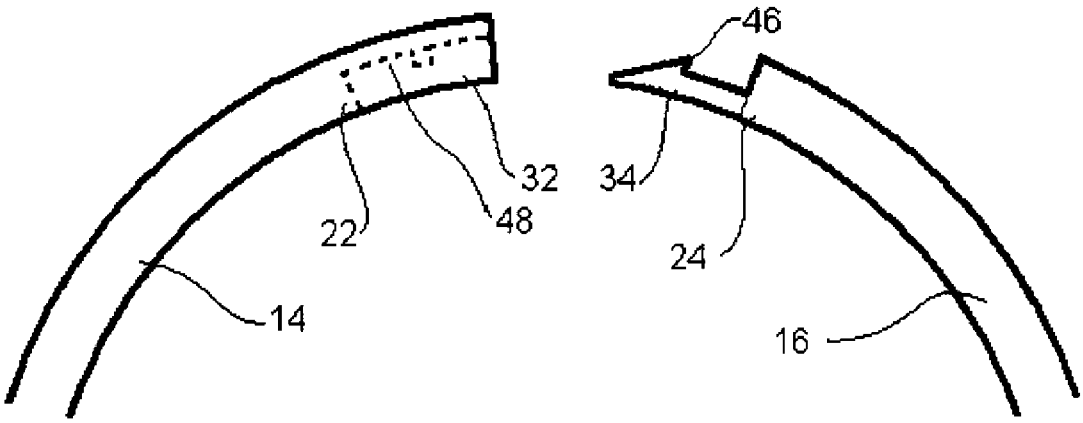
FIGS. 8 through 11 are detailed views of alternative interlocking components.
Figure 9:
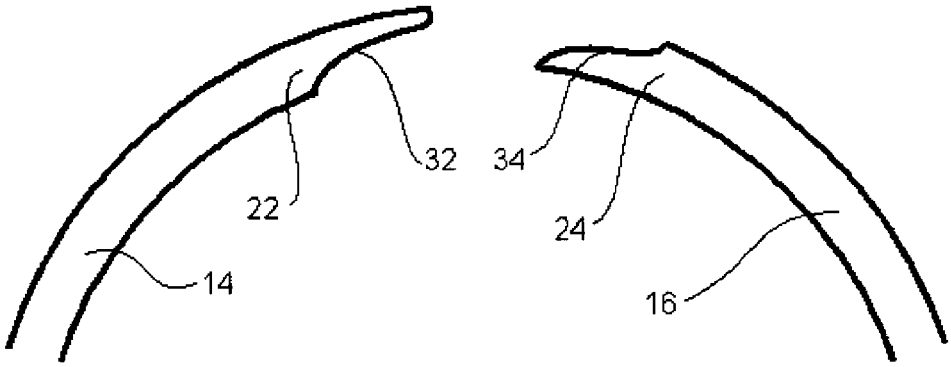
Figure 10:
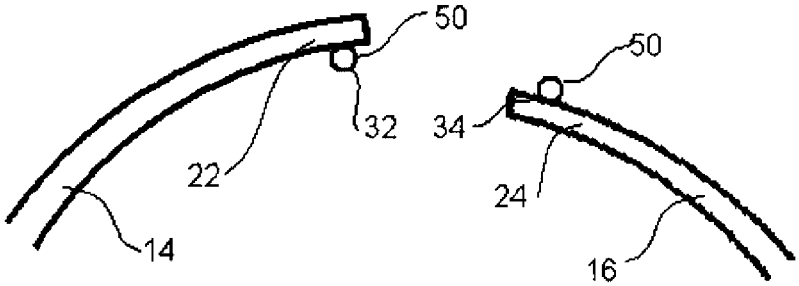
Figure 11:
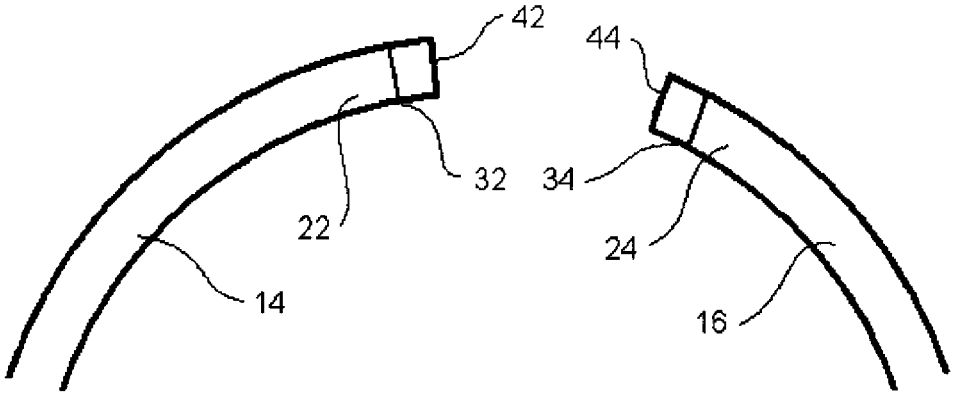

Use of Alternative Engagements:

Referring to FIG. 8, first engagement 32 and second engagement 34 engage each other in a male/female fashion with a projection 46 engaging an indentation 48 such that second engagement 34 must be pushed back or first engagement 32 pulled forward to release the engagement. Referring to FIG. 9, first and second engagements 32 and 34 engage in an overlapping fashion, such that, when engaged, annular body 12 is continuous. There may or may not be a connection that resists disengagement. Referring to FIG. 10, first and second engagements 32 and 34 engage in an overlapping fashion, and have projections 50 that, when engaged, keep annular body 12 closed. Referring to FIG. 11, first and second engagements 32 and 34 have a magnetic engagement using magnetic components 42 and 44. Magnetic components 42 and 44 may have opposite polarized ends directed toward each other, or one may be a magnet and the other a conducting metal. FIG. 11 shows first and second engagements 32 and 34 meeting directly with no overlap or male/female connection. It will be understood that this arrangement is possible without magnetic components 42 and 44, which magnetic components 42 and 44 may be integrated into other means of engagement.

Figure 5:
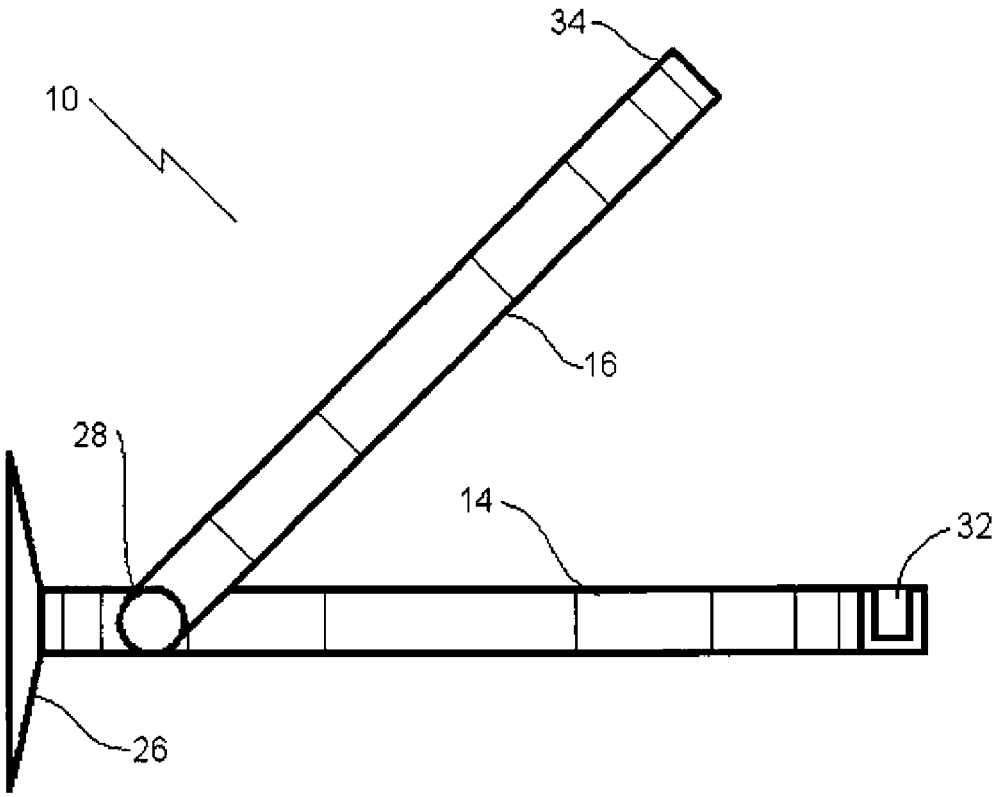
FIG. 5 is a side view of the curtain holder of FIG. 1 with an alternative hinge.

Alternative Mounting Means:

Referring to FIG. 5, mounting plate 26 is shown to be tapered on the sides, rather than rectangular as shown for example in FIG. 1. Referring to FIG. 7, mounting plate 26 is integral to annular body 12. In addition, instead of screws, an adhesive could be used to attach mounting plate 26 to vertical surface 27.

Figure 19:
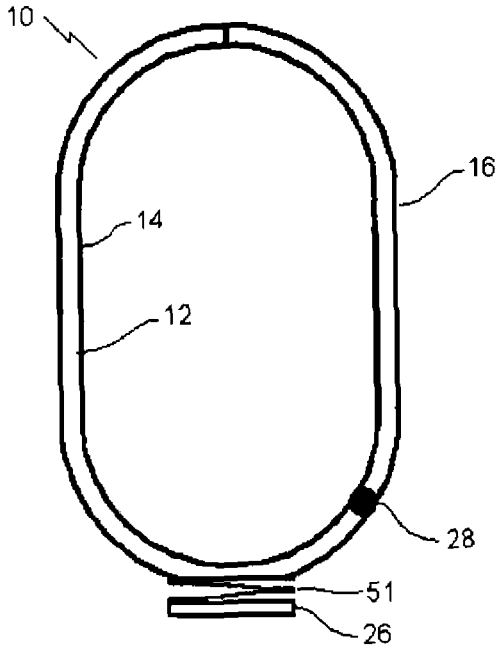
FIG. 19 is a top plan view of a curtain holder mounted on a spring.

Referring to FIG. 19, mounting plate 26 includes a spring 51 such that body 12 is able to move when pressure is applied to either side. This prevents undue damage when curtain holder 10 is accidentally bumped.

Figure 12:
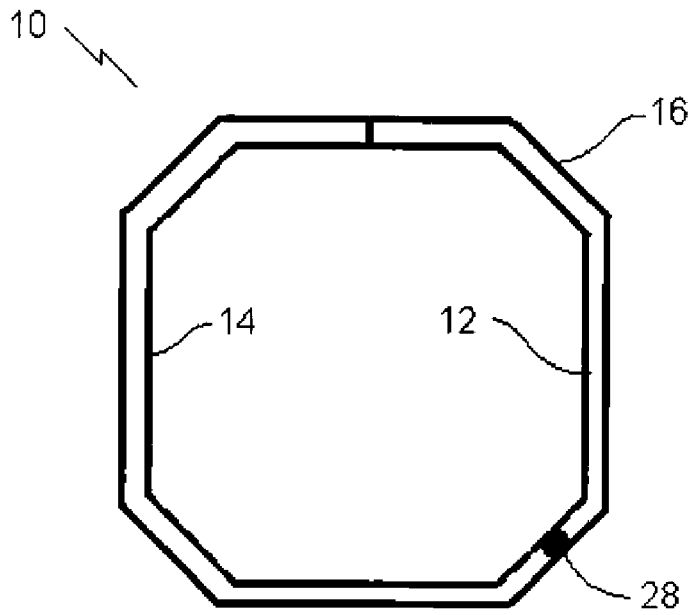
FIGS. 12 through 15 are top plan views of alternative body shapes.
Figure 13:
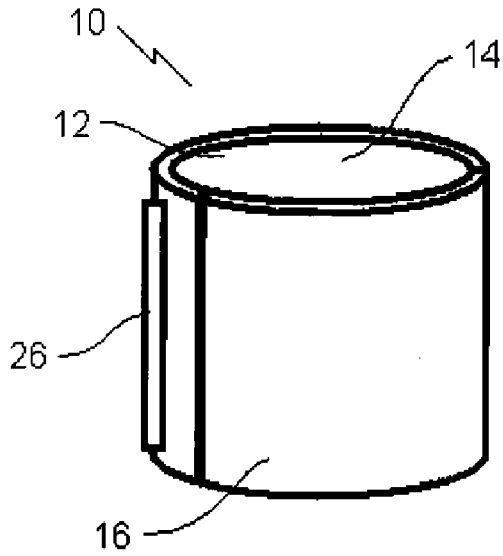
Figure 14:
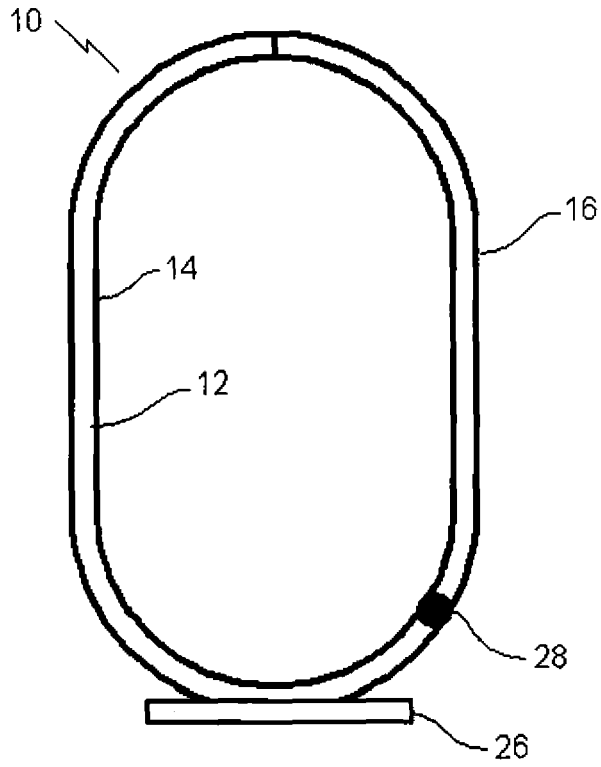
Figure 15:
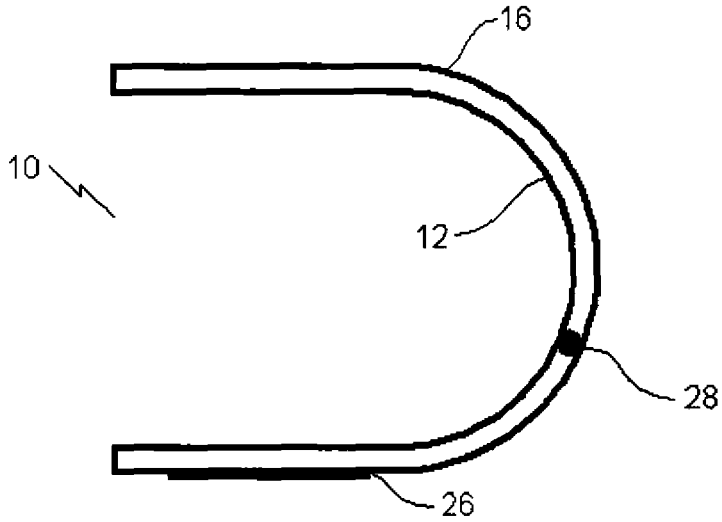
Figure 16:
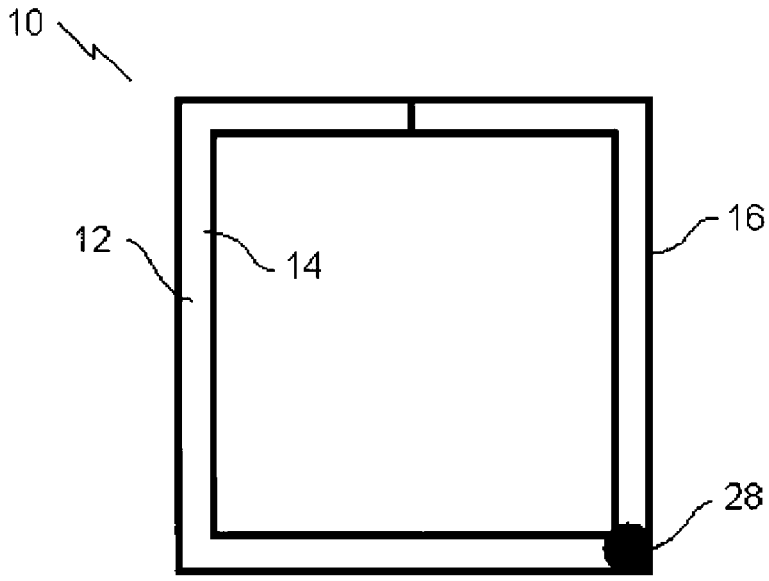
FIG. 16 is a side perspective view of an alternative body shape.
Figure 17:
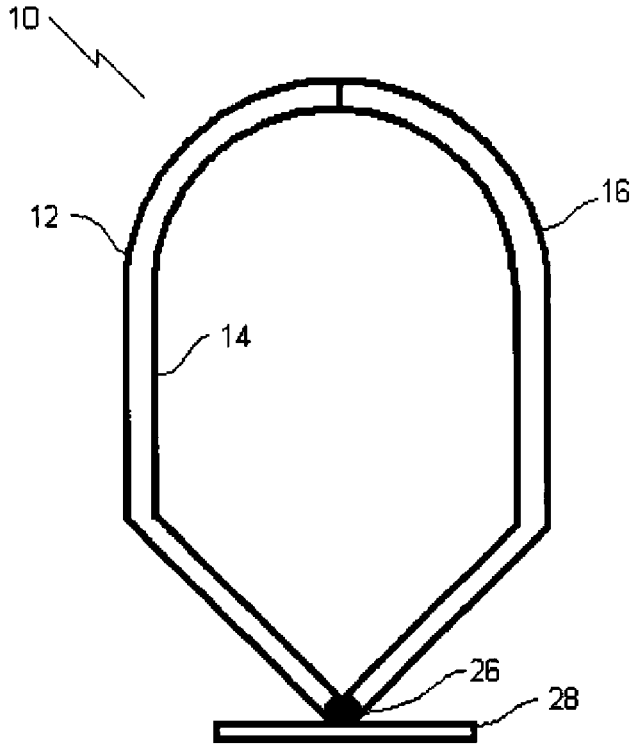
FIGS. 17 and 18 are top plan views of further alternative body shapes.

Alternative Shapes of Body 12:

Referring now to FIGS. 12 through 16, annular body 12 need not be circular in shape. FIG. 12 shows body 12 as an octagon. FIG. 13 shows body 12 as a sleeve. FIG. 14 shows body 12 as an oval. FIG. 15 shows body 12 that is substantially annular but does not entirely enclose a curtain. For this embodiment, engagement means are unnecessary. FIG. 16 shows body as a square. FIGS. 17 and 18 show two other possible shapes for body 12.

Figure 20:
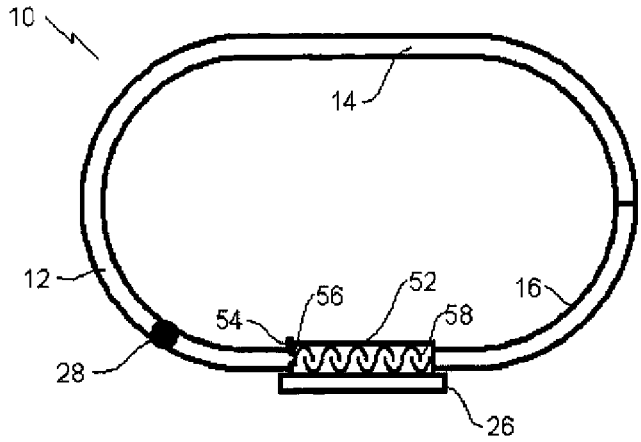
FIG. 20 is a top plan view in partial section of a rotatable curtain holder.
Figure 21:
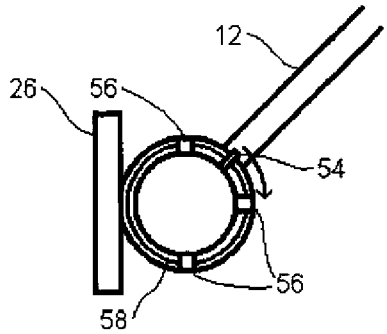
FIG. 21 is an end view in section of the curtain holder in FIG. 20 being rotated.

Hinge to Permit Vertical Movement:

Referring to FIG. 20, body 12 may be adapted to rotate about a second hinge 52 such that body 12 can be moved between a vertical position and a horizontal position. The vertical position allows curtain holder 10 to be place out of the way when not holding a curtain, or to hold a curtain close to the wall. Body 12 includes a protrusion 54 that corresponds to a depression 56 in the side of hinge 52 to lock the position of body 12, while a spring 58 holds them in contact. Referring to FIG. 21, three depressions 56 are included to allow for three possible positions of body 12.

Multiple Connected Segments:

Although two connected segments have been illustrated for most embodiments, it will be appreciated that there could just as easily be three or more connected segments.

Figure 22:
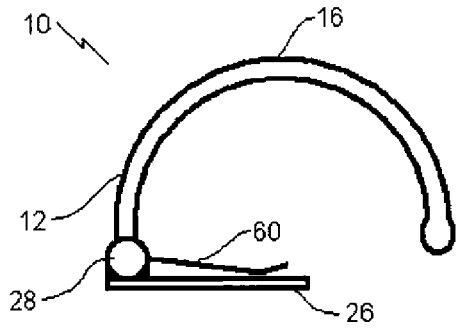
FIG. 22 is a top plan view of a curtain holder with a curtain clip.

Curtain Holding Means:

Referring to FIG. 22, a curtain clip 60 may be included to hold the end of a curtain.

Figure 23:
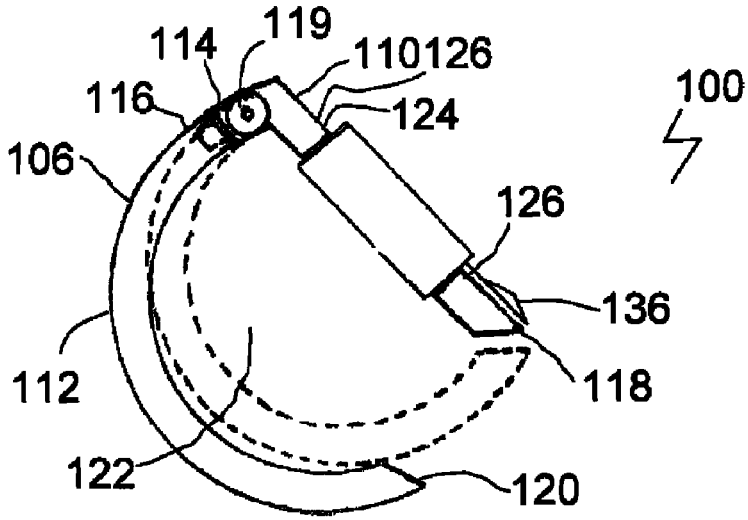
FIG. 23 is a perspective view of a commercial embodiment of curtain holder.
Figure 24:
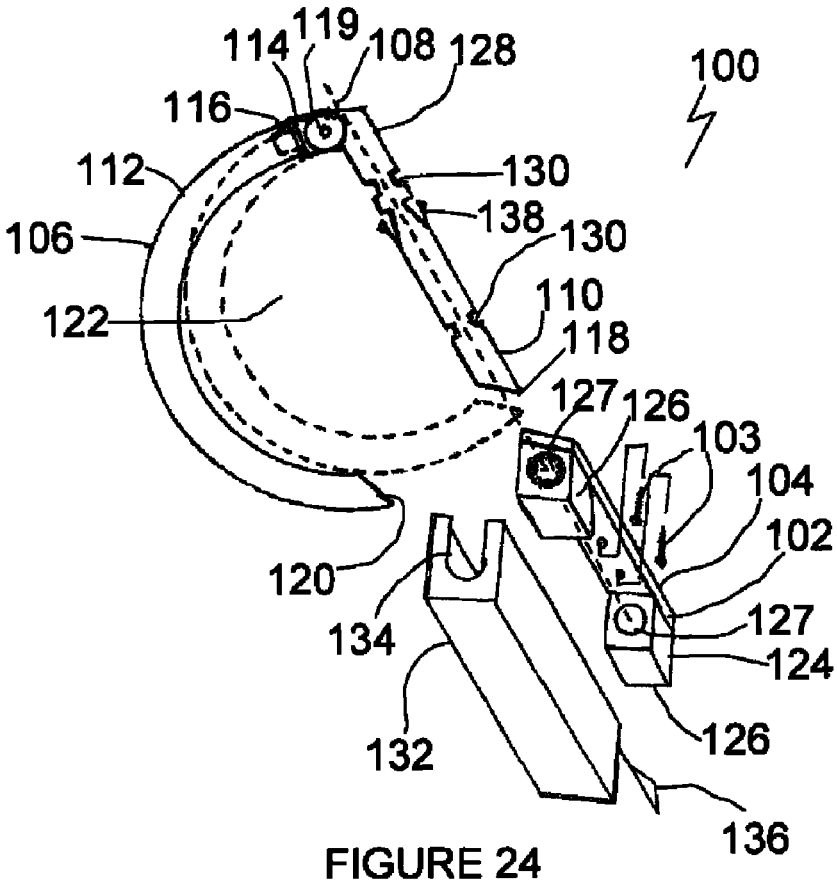
FIG. 24 is an exploded perspective view of the curtain holder illustrated in FIG. 23.

Commercial Embodiment:

Referring to FIGS. 23 and 24, there will now be described an embodiment which is a variation of the embodiment illustrated and described in FIGS. 20 and 21.

Referring to FIG. 24, a curtain holder 100 includes a mounting plate 102 with a flat surface 104 for mounting flush against a vertical surface. Mounting plate 102 may be mounted to the vertical surface by screws 103 as shown in the present embodiment, or any other method that would secure mounting plate 102 to the vertical surface. A substantially annular body 106 is pivotally mounted to mounting plate 102 for pivotal movement about a horizontal pivot axis 108 that extends parallel to mounting plate 102. Body 106 has two body segments 110 and 112 with each segment 110 and 112 having a connection end 114 and 116, respectively, and a remote end 118 and 120, respectively. Connection ends 114 and 116 of body segments 110 and 112 are pivotally connected for pivotal movement about a substantially vertical pivot axis 119, represented as being a hinge, which is offset from and independent of mounting plate 102. Referring to FIG. 23, body segments 110 and 112 are pivotally movable relative to each other between a closed position and an open position. In the closed position, remote ends 118 and 120 of body segments 110 and 112 are closely spaced so that body 106 defines a curtain confining enclosure 122. hi the open position, remote ends 118 and 120 of each of body segments 110 and 112 are spaced apart to permit insertion of a curtain into curtain confining enclosure 122.

Referring to FIG. 24, mounting plate 102 supports a female receiver 124 in a horizontal orientation. Female receiver 124 includes more than one spaced receiver segments 126 with axially aligned bores 127 which define horizontal pivot axis 108. Body segment 110 of body 106 is a male member 128 which is received in female receiver 124 in mating relation. Male member 128 rotates in female receiver 124 to create pivotal movement of body 106 about horizontal pivot axis 108. Male member 128 has at least one circumferential groove 130 which is used in conjunction with a locking clip 132. Locking clip 132 overlays female receiver 124 and has at least one lip 134 which engages the at least one groove 130 on male member 128. Locking clip 132 may also have an axially extending finger 136 which is used to catch and hold the end of a curtain against a vertical surface such as a wall. Male member 128 may have radially movable outwardly biased spring metal fingers 138 which engage one of receiver segments 126 to prevent male member 128 from sliding out of female receiver 124.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A curtain holder, comprising:

a mounting plate having a flat surface for mounting flush against a vertical surface, the mounting plate supports a female receiver in a horizontal orientation, the female receiver comprising at least one receiver segment with a bore defining the horizontal pivot axis;

a substantially annular body pivotally mounted to the mounting plate for pivotal movement about a horizontal pivot axis extending parallel to the mounting plate, such that the body moves up and down about the horizontal pivot axis;

the body has at least two body segments pivotally connected for pivotal movement about a substantially vertical pivot axis which is offset from and independent of the mounting plate, such that the body segments pivot relative to each other about the vertical pivot axis between a closed position in which the body defines a curtain confining enclosure and an open position in which at least one of the body segments pivots about the vertical pivot axis away from the mounting plate to permit insertion of a curtain into the curtain confining enclosure; and one of the two body segments of the body is a male member which is received in the female receiver in mating relation, the male member rotating in the female receiver to create pivotal movement of the body about the horizontal first pivot axis.

2. The curtain holder of claim 1, wherein:

the male member has at least one circumferential groove;

a locking clip overlies the female receiver, the locking clip having at least one lip which engages the at least one groove on the male member.

3. The curtain holder of claim 2, wherein the locking clip has an axially extending finger.

4. The curtain holder of claim 1, wherein the female receiver is comprised of more than one spaced receiver segments with axially aligned bores defining the horizontal pivot axis.

5. The curtain holder of claim 4, wherein the male member has radially movable outwardly biased spring metal fingers which engage one of the receiver segments.

6. A curtain holder, comprising:

a mounting plate having a flat surface for mounting flush against a vertical surface;

a substantially annular body pivotally mounted to the mounting plate for pivotal movement about a horizontal pivot axis extending parallel to the mounting plate; the body having two body segments each having a connection end and a remote end, the connection end of the body segments being pivotally connected for pivotal movement about a substantially vertical pivot axis which offset from and independent of the mounting plate, such that the body segments are pivotally movable relative to each other between a closed position in which the remote end of the body segments are closely spaced so that the body defines a curtain confining enclosure and an open position in which the remote end of each of the body segments are spaced apart to permit insertion of a curtain into the curtain confining enclosure;

the mounting plate supports a female receiver in a horizontal orientation, the female receiver being comprised of more than one spaced receiver segments with axially aligned bores defining the horizontal pivot axis;

one of the two body segments of the body is a male member which is received in the female receiver in mating relation, the male member rotating in the female receiver to create pivotal movement of the body about the horizontal pivot axis;.

the male member having at least one circumferential groove;

a locking clip overlying the female receiver, the locking clip having at least one lip which engages the at least one groove on the male member.

7. The curtain holder of claim 6, wherein the male member has radially movable outwardly biased spring metal fingers which engage one of the receiver segments.

8. The curtain holder of claim 6, wherein the locking clip has an axially extending finger.

* * * * *